US005860655A

United States Patent [19]

Starrett

[11] Patent Number: 5,860,655

[45] Date of Patent: Jan. 19, 1999

[54] ARCHERY TARGETING SYSTEM AND METHOD

[75] Inventor: Kenneth E. Starrett, Arlington, Tex.

[73] Assignee: American Excelsior Company, Arlington, Tex.

[21] Appl. No.: 947,814

[22] Filed: Oct. 9, 1997

Related U.S. Application Data

[63] Continuation of Ser. No. 628,240, Apr. 4, 1996, abandoned.

[51] Int. Cl.[6] ..... F41J 3/00

[52] U.S. Cl. ..... 273/408; 273/407; 273/409

[58] Field of Search ..... 273/403, 404, 273/407, 408, 409

[56] References Cited

U.S. PATENT DOCUMENTS

| | | | |
|---|---|---|---|
| D. 325,937 | 5/1992 | Fagan | D21/6 |
| D. 329,665 | 9/1992 | Carroll | D21/5 |
| D. 330,920 | 11/1992 | Schaefer et al. | D21/5 |
| D. 333,683 | 3/1993 | Trachet | D21/5 |
| D. 382,599 | 8/1997 | Starrett | D21/5 |
| 613,386 | 11/1898 | McKenney . | |
| 2,039,352 | 5/1936 | Ross | 273/407 |
| 2,170,850 | 8/1939 | Bonnett et al. | 273/403 |
| 2,770,460 | 11/1956 | Deasy | 273/407 X |
| 3,048,401 | 8/1962 | Dishon | 273/407 |
| 3,088,738 | 5/1963 | Meyer | 273/407 |
| 4,054,288 | 10/1977 | Perrine, Sr. | 273/407 |
| 4,248,431 | 2/1981 | Burnes | 273/187 |
| 4,915,384 | 4/1990 | Bear | 273/26 |
| 4,915,387 | 4/1990 | Baxstrom | 273/187 |
| 5,125,669 | 6/1992 | Kanda | 273/411 |
| 5,211,404 | 5/1993 | Grant | 273/407 |
| 5,280,920 | 1/1994 | Knapper, II | 273/407 |

OTHER PUBLICATIONS

Sears Christmas Catalog, 1969, p. 407.

Brochure regarding Curlex Power Stop, by American Excelsior Company.

Brochure regarding U.S. Patent No. 4,042,240 entitled "The PROMAT—The Only Archery Target of Its Kind," Impact Industries, Inc., 1990.

*Primary Examiner*—William H. Grieb

*Attorney, Agent, or Firm*—Jenkens & Gilchrist, P.C.

[57] ABSTRACT

An archery target incicia comprising an enlarged, color-distinguished cross-hair representation utilizing orthogonal line systems for use in conjunction with an archery targeting sight. The enlarged cross-hair indicia can be used in conjunction with a conventional bulls-eye representation or without such a center designation while facilitating an accuracy indication for arrows fired into the target. The enlarged cross-hair indicia effectively simulates a cross-hair sight from an archery bow which affords the user the opportunity to make a cross-hair alignment with the arrow loaded into the archery bow to facilitate archery training and shooting accuracy.

11 Claims, 1 Drawing Sheet

ARCHERY TARGETING SYSTEM AND METHOD

This application is a continuation of application Ser. No. 08/628,240, filed on Apr. 4, 1996, which was abandoned upon the filing hereof.

BACKGROUND OF THE INVENTION

1. Field of the Invention

The present venture relates to targets and targeting systems and, more particularly, to an archery targeting system and method incorporating an archery bow and related target indicia facilitating training and improved accuracy in the use thereof.

2. History of the Prior Art

The use of upstanding padded targets in conjunction with archery bows dates back into technological antiquity. Bales of straw, cotton and other fibers have, in the past, served as such target structures. These target assemblies may be covered with a burlap, paper or other fabric to both contain the fibers as well as provide an aesthetically pleasing surface upon which a target indicia may be applied. Typically, the target indicia for an archery system includes a concentric circle array commonly referred to as a "bulls-eye."

The use of "bulls-eye" indicia has become wide spread in conventional times. Such indicia of this type is found on printed paper which may be placed on walls, boxes, bales and other target areas for use with a variety of weapons. When the weapons include firearms, the use of a targeting scope is a possibility. Scopes often incorporate optical lenses and cross-hairs in the construction thereof. The cross-hair affords the user the opportunity to determine vertical and horizontal alignment in the targeting process. The cross-hair design has, in fact, been used for decades in establishing target alignment for weapons of many varieties. It is obviously a more difficult task to provide such a cross-hair design for archery systems, although attempts have been made.

Archery targets of today may be formed of new, lightweight materials. One such target sold by the assignee of the present invention includes high-density polyethylene foam with pivotal leg braces to facilitate use. The target face generally comprises the conventional concentric bulls-eye design referenced above. While effective in establishing the degree of accuracy of the user relative to deviation from intended "dead center," the bulls-eye design is not particularly effective in establishing a direct deviation correlation between vertical and horizontal axes. Archery bows are today constructed with targeting systems such as alignment sights. Sights may include adjustable devices allowing some degree of alignment of the arrow being fired. In this manner, archery bows can be utilized with a much higher degree of fun and accuracy. It is also useful in archery targeting to align the archery sight with the target area and know the exact deviation from the original sighting for purposes of training and subsequent targeting. Since cross-hair designs of substantial size are not available for archery bow sights, or when manually sighting from the arrow tip when no sight is available, it would be an advantage to incorporate an inexpensive, large cross-hair indicia in the archery targeting system and/or process for enhancing the accuracy thereof.

The present invention addresses the problems of the prior art by providing an enlarged, cross-hair indicia for effectively simulating a cross-hair sight from an archery bow for archery targeting by utilizing a full target surface having a color emphasized cross-hair indicia displayed directly thereon. The colored cross-hair indicia may also include a conventional bulls-eye displayed in a central region thereof while cross-hairs extend outwardly therefrom for direct utilization in conjunction with the archery bow sight. A textured face may also be used to reduce glare.

SUMMARY OF THE INVENTION

The present invention relates to an enlarged, color distinguished cross-hair indicia for utilization with archery targeting. More particularly, one aspect of the present invention comprises a targeting system for an archery bow incorporating a target adapted for impact of an arrow fired from the bow; means for sighting an arrow placed on the bow; and relatively enlarged, color distinguished indicia disposed on the target for facilitating the sighting of the arrow and the determination of the deviation of flight of the arrow subsequent to firing. The enlarged indicia comprises a cross-hair design of sufficient size and color to effectively simulate a cross-hair sight from an archery bow and enable visual acuity thereof from a relatively long distance, as necessary for archery targeting.

In another aspect, the cross-hair design of the above-described invention includes an orthogonal line array wherein the line array establishes a vertical orientation and is formed of an overall length greater than at least 40 percent of the length of a conventional bow. The horizontal line array is substantially equivalent to the length of the vertical line array and further includes an array of concentric circles disposed in the region of the intersection of the vertical line array. In one embodiment, the target face is textured to reduce glare and enhance visual acuity.

In another aspect, the present invention includes a method of targeting for an archery bow. More particularly, the method comprises the steps of (1) providing a target adapted for impact of an arrow released from the bow; (2) providing means for targeting an arrow mounted on the bow; (3) forming relatively enlarged indicia on the target with a cross-hair design of sufficient size to enable visual acuity thereof with the targeting site of the bow; and (4) sighting the arrow from the bow in relation to the cross-hair design and determining the deviation of flight of the arrow subsequent to its release.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Figure 1:
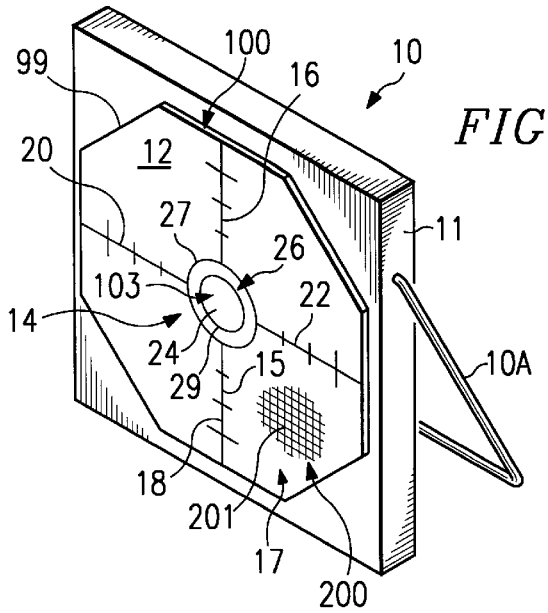
FIG. 1 is a perspective view of an archery target constructed in accordance with the principles of the present invention.

Referring now to FIG. 1 there is shown an archery target constructed in accordance with the principles of the present invention. The archery target 10 includes a pad 11 having a surface 12 with relatively large indicia 14 formed thereon and including a representation of a conventional "cross-hair" design 15 highlighted by an octagonal background 17 which is preferably of a bright color, such as red. The cross-hair design 15 is, of course, an accepted targeting, sighting system that has been prevalent in sighting gun scopes in the prior art. The present, enlarged, highlighted indicia 14 presents a targeting cross-hair design 15 and colored background 17 on the surface 12 of pad 11. The term "relatively large" and "enlarged" refers to the size of the cross hair and background relative to the face of the target as described below.

Still referring to FIG. 1, the indicia 14 of design 15 includes a pair of end to end vertical lines 16 and 18 which are aligned to intersect, along notional (i.e., not seen) extension lines, a pair of end to end horizontal lines 20 and 22. The vertical lines 16 and 18 and horizontal lines 20 and 22 meet along said notional lines in a center region 24 wherein a bulls-eye configuration 26 has been disposed. The bulls-eye configuration 26 comprises concentric rings 27 and 29. Outer ring 27 intersects the various lines 16, 18, 20 and 22. Other designs, such as shaped objects, are also contemplated in place of the rings 27 and 29, or in conjunction therewith.

In a preferred embodiment, the target 10 is constructed on the order of 22 inches in width by 24 inches in height. The length of the vertical cross-hair lines 16 and 18 and horizontal cross-hair lines 20 and 22 in such a target is preferably on the order of 21 inches, or greater than about 40% of the length of a 42"–48" bow which may be used therewith. This size relationship includes long bows, compound bows and cross-bows. This enlarged, color distinguished indicia 14 and its size affords the user an image of the cross hair design 15 that will be sufficient to mentally simulate the use of a gun scope at conventional archery distances on the order of 25 yards. A cross-hair line length of 50% of the length of the bow being used affords even more visual acuity and accuracy determination at conventional shooting distances.

Figure 2:
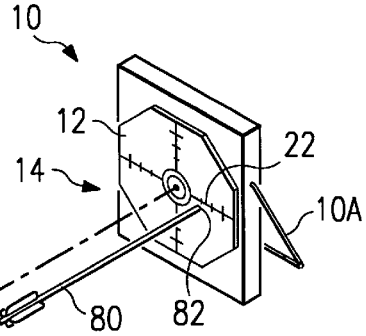
FIG. 2 is a diagrammatic perspective view of an archery bow used in conjunction with the target of FIG. 1 illustrating the operation thereof.

Referring now to FIG. 2, there is shown a diagrammatic, perspective view of the targeting system 50 of the present invention. System 50 comprises an archery bow 51, sighting member 58, and indicia 14 of surface 12. As shown herein the bow 51 includes an arrow 52 mounted across a bow string 54 and bow frame 56. The targeting or sighting member 58 is representatively shown on the bow. Such devices often include means for varying elements thereof relative to the bow frame 56 in order to facilitate targeting alignment by the user after releasing the arrow 52 into the target 10. As described above, it has not been commercially feasible to mount a scope in place of a targeting sight 58 in view of the overall construction of the bow 51 and the functional restrictions of such an assembly. By utilizing the enlarged, color highlighted cross-hair indicia 14 on the surface 12 of the target 10, the person using the bow 51 may more accurately aim and ascertain the degree of accuracy of an arrow 52 released into the target 10. An arrow 80 is shown in FIG. 2 having penetrated the target 10 along a portion 82 of horizontal line 22. With this particular firing the user can compare the end result accurately with regard to the original sighting by the enlarged cross-hair indicia 14 seen from sighting member 58. If no sighting member 58 is available on the bow 51, the user may "sight" the arrow in the conventional fashion using the "tip" of the arrow.

Referring still to FIG. 2, adjustments in the manner of releasing the arrow 52 into the target 10 (also referred to herein as "firing the arrow") can be made by the operator by judging the degree of deviation from the center of the target 10 relative to that observed through the targeting device 58 of the bow 51. Precise adjustments can be made as compared to the use of a bulls-eye which only indicates a radial and circumferential positioning relative to a center.

Figure 3:
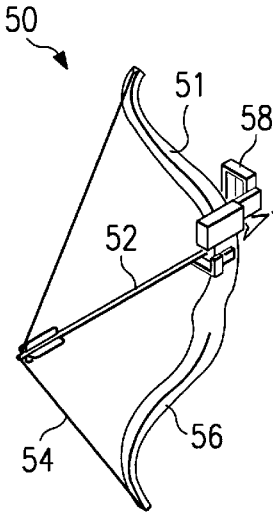
FIG. 3 is a front elevational view of the bow and target of FIG. 2.
Figure 3:
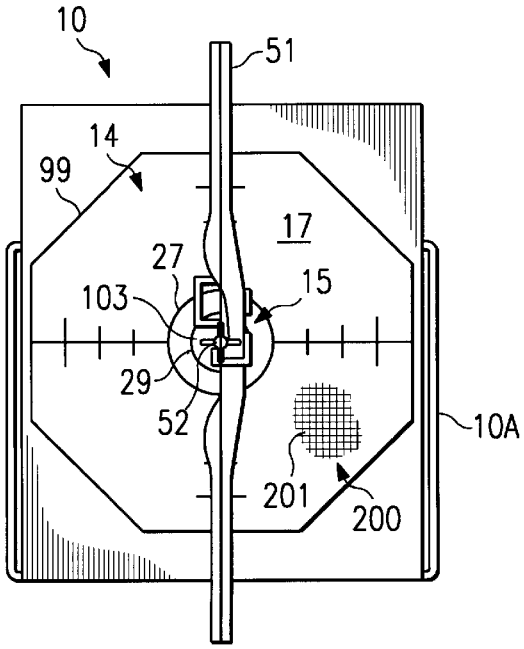

Referring now to FIG. 3, there is shown the target 10 as it would be observed by a user holding a bow 51. The enlarged indicia 14 appears with such size and clarity that the user can mentally simulate a scope cross-hair sight with little effort. The octagonal, colored background 17 facilitates viewing clarity. The arrow 52 is then pointed toward the center of target 10 in a position aligned with the cross hair design 15. Once the arrow is released, the deviation produced by the position of arrow 80 from the target center (FIG. 2) determines the accuracy of the release of the arrow 52 and/or the initial sighting and targeting thereof.

Referring now to FIGS. 1–3 in combination, it may be seen that the present invention comprises apparatus for enhanced archery bow sighting. Although a particular octagonal shape for the design 15 is set forth and shown, a variety of other shapes may also be included within the scope of the present invention. For example, the straight sides 99 of the octagonal shape 100 (FIG. 1) may be altered to include arcuate or curvilinear designs. In addition, the size of the vertical and horizontal lines 16, 18, 20 and 22 may be varied in accordance with the principles of the present invention. The indicia 14 is also shown imprinted on a sheet of paper or plastic which is placed upon a commercially available embodiment of a target comprising a layered, high-density polyethylene foam, or the like, which has the power to stop arrows therein. The target is supported by pivotal legs 10A (shown in FIGS. 1, 2, 3) which may be collapsed to the rear portion thereof for ease in handling and disposition at a shooting range. A foam target having such pivotal legs is currently sold by the assignee of the present invention and others in the industry.

Referring still to FIG. 3, the present invention may also be constructed with a replaceable central core 103, the outside diameter of which is substantially equivalent to outer ring 27 of indicia 14. The replacement core 103 facilitates the ability to maintain extra life to the overall target by replacing the area theoretically having the most penetrations. With such a replacement center core 103 and the unique target facing of indicia 14 of the present invention, the archery enthusiast is given a chance to fine-tune the use of the archery bow by being able to concentrate on the bright red color of the target while the cross-hair pattern gives him more precise information on the alignment thereof.

Finally, a preferred embodiment of the target 10 includes the indicia 14 having a textured surface to reduce glare. The paper or plastic upon which indicia 14 is printed will, in such an embodiment, include a three dimensional embossed pattern 200, illustrated by lines 201 in FIGS. 1 and 3. The pattern 200 will reduce glare from light shining on the target as may be necessary to fully utilize the indicia 14. Such considerations are not necessary for conventional paper targets which are "hung" on bales of hay. The present target includes a shiny red surface, preferably formed of polyethylene plastic which is flame laminated to the foam target base. The high gloss surface is made for viewing acuity of the large cross-hair design and glare is a critical concern that is corrected by said textured surface. For this reason, the textured surface pattern 200 is an important aspect of the present invention.

It is thus believed that the operation and construction of the present invention will be apparent from the foregoing description. While the method and apparatus shown or described has been characterized as being preferred it will be obvious that various changes and modifications may be made therein without departing from the spirit and scope of the invention as defined in the following claims.

I claim:

1. A method of targeting arrows from an archery bow comprising the steps of:

providing a target having a face adapted for impact of an arrow released from said bow;

providing means for aligning an arrow on said bow relative to said target;

forming enlarged indicia on said target with a cross-hair design extending substantially across said face of said target exposed to the archery bow for alignment with said target and of sufficient size to enable visual acuity thereof with said targeting site of said alignment means; and sighting said arrow from said bow in relation to said cross-hair design and determining the deviation of flight of said arrow subsequent to its release.

2. The method as set forth in claim 1 wherein said step of forming said cross-hair indicia comprises the steps of forming an orthogonal line array comprising horizontal and vertical line arrays for designating the relatively vertical and horizontal orientation of an arrow released from said bow.

3. The method as set forth in claim 2 including the step of forming said vertical line array of an overall length greater than at least 40 percent of the length of said bow with said bow having a length of at least 42 inches.

4. The method as set forth in claim 3 including the step of forming said vertical line array of a length substantially equivalent to fifty percent of the length of said bow with said bow having a length of at least 42 inches.

5. The method as set forth in claim 4 including the step of forming said horizontal line array to be substantially equivalent in length to the length of said vertical line array.

6. The method as set forth in claim 1 and further including the step of forming an array of concentric circles in the region of the intersection of said cross-hair indicia.

7. The method as set forth in claim 1 wherein said step of forming said cross-hair indicia comprises the steps of texturing said face of said target to reduce glare.

8. The method as set forth in claim 1 including the step of forming upon said face an array of a first circle and at least one smaller concentric circle in a central region of said indicia.

9. The method as set forth in claim 8 and further including the step of forming said target with a replaceable circular center core having a diameter generally equivalent to the diameter of said first circle.

10. The method as set forth in claim 9 including the step of forming said target from high density foam.

11. An archery bow target for impact of an arrow comprising:

a target body having a face adapted for impact of said arrow released from said bow and a colored background;

enlarged indicia disposed across said face of said target for facilitating the sighting of said arrow prior to its release from said bow, and the determination of the deviation of flight of said arrow subsequent to its release from said bow;

said enlarged indicia comprising a cross-hair design disposed across said colored background, said indicia extending substantially across said target face exposed to the archery bow for alignment with said target face to enhance visual acuity thereof from said bow;

said cross-hair indicia further including an orthogonal line array; and wherein said indicia further includes a textured surface disposed across said target face and includes a leg brace pivotally mounted thereto and adapted for extension outwardly therefrom for support of said target in an upright position and the display of said indicia in a configuration generally orthogonal to said arrow position in said bow.

* * * * *